US006643996B2

(12) United States Patent
Spatafora et al.

(10) Patent No.: US 6,643,996 B2
(45) Date of Patent: Nov. 11, 2003

(54) METHOD OF OVERWRAPPING PACKETS

(75) Inventors: Mario Spatafora, Bologna (IT); Fabrizio Tale, Bologna (IT)

(73) Assignee: G.D. Societa' Per Azioni, Bologna (IT)

( * ) Notice: Subject to any disclaimer, the term of this patent is extended or adjusted under 35 U.S.C. 154(b) by 0 days.

(21) Appl. No.: 10/144,349

(22) Filed: May 10, 2002

(65) Prior Publication Data

US 2002/0189207 A1 Dec. 19, 2002

(30) Foreign Application Priority Data

May 11, 2001 (IT) ..... BO2001A00290

(51) Int. Cl.[7] ..... B65B 11/00

(52) U.S. Cl. ..... 53/466; 53/461; 53/416; 53/376.2; 53/228; 53/232

(58) Field of Search ..... 53/461, 466, 416, 53/376.2, 377.8, 228, 230, 232, 234

(56) References Cited

U.S. PATENT DOCUMENTS 3,813,849 A * 6/1974 Stambera et al. ..... 53/234
4,092,816 A * 6/1978 Seragnoli ..... 53/234
4,999,970 A * 3/1991 Bamrungbhuet et al. ..... 53/176
5,701,725 A * 12/1997 Neri et al. ..... 53/466
5,822,948 A * 10/1998 Manservigi et al. ..... 52/466
5,839,253 A * 11/1998 Draghetti ..... 53/234
5,996,318 A * 12/1999 Draghetti ..... 53/466
6,000,199 A * 12/1999 Boldrini ..... 53/466

FOREIGN PATENT DOCUMENTS

EP 0 135 818 4/1985
EP 0 900 731 3/1999

* cited by examiner

*Primary Examiner*—Rinaldi I. Rada
*Assistant Examiner*—Hemant Desai
(74) *Attorney, Agent, or Firm*—Marshall, Gerstein & Borun LLP

(57) ABSTRACT

A method of overwrapping packets in the form of a rectangular prism, whereby a packet, as it is fed continuously along a wrapping path, is first centered with respect to a relative conveying seat, and is then paired with a relative sheet of wrapping material, which is folded about the packet to form a tubular wrapping projecting axially from the packet in the form of two tubular appendixes, which are folded to form a closed overwrapping; each tubular appendix being at least partly folded onto the relative packet before the relative tubular wrapping is completed.

28 Claims, 7 Drawing Sheets

METHOD OF OVERWRAPPING PACKETS

The present invention relates to a method of overwrapping packets.

The present invention may be used to advantage in the tobacco industry for overwrapping packets of tobacco products, in particular packets of cigarettes, to which the following description refers purely by way of example.

BACKGROUND OF THE INVENTION

More specifically, the present invention relates to a method (for example as disclosed in EP 0135818) of overwrapping packets substantially in the form of a rectangular prism defined axially by two opposite end surfaces, and laterally by two major lateral surfaces and two minor lateral surfaces parallel to a longitudinal axis of the rectangular prism; the packets being overwrapped as they are fed, in a given feed direction, along a given wrapping path; and the method comprising, for each packet, a pairing step to pair the packet with a relative sheet of wrapping material; a first folding step to fold the sheet of wrapping material into a U about the packet so that the sheet has two projecting lateral portions, each projecting from a respective said end surface; a second folding step to further fold the sheet of wrapping material about the packet and form, about the packet, a tubular wrapping comprising two tubular appendixes projecting from respective said end surfaces of the packet and defined by said two projecting portions of the sheet; a sealing step to stabilize said tubular wrapping; and a third folding step to fold each said tubular appendix onto the respective end surface of the packet to obtain a closed overwrapping; said packet being fed continuously along said wrapping path; and each said projecting lateral portion of the sheet of wrapping material being folded at least partly onto the relative said end surface prior to said second folding step.

SUMMARY OF THE INVENTION

It is an object of the present invention to perfect the above known method to speed up the wrapping procedure, and to minimize and at the same time simplify the devices required to perform the wrapping procedure.

According to the present invention, there is provided a method of overwrapping packets substantially in the form of a rectangular prism defined axially by two opposite end surfaces, and laterally by two major lateral surfaces and two minor lateral surfaces parallel to a longitudinal axis of the rectangular prism; the packets being overwrapped as they are fed, in a given feed direction, along a given wrapping path; the method comprising, for each packet, a pairing step to pair the packet with a relative sheet of wrapping material;

a first folding step to fold the sheet of wrapping material into a U about the packet so that the sheet of wrapping material has two projecting lateral portions, each projecting from a respective said end surface;

a second folding step to further fold the sheet of wrapping material about the packet and form, about the packet, a tubular wrapping comprising two tubular appendixes projecting from respecttive said end surfaces of the packet and defined by said two projecting lateral portions; a sealing step to stabilize said tubular wrapping;

and a third folding step to fold each said tubular appendix onto the respective end surface of the packet to obtain a closed overwrapping;

said packet being fed continuously along said wrapping path; and each said projecting lateral portion of the sheet of wrapping material being folded at least partly onto the relative said end surface prior to said second folding step;

the method being characterized by comprising, prior to said pairing step, a centering step to center the packet with respect to said wrapping path; the centering step being performed by gripping said packet, by means of a first gripper, by two of said lateral surfaces; feeding the packet axially along a respective portion of said wrapping path by means of said first gripper; rotating said first gripper about a turn-around axis crosswise to said wrapping path and to said longitudinal axis so as to position the packet with a first of said two lateral surfaces forward; and transferring said packet to a second gripper, which grips the packet by said two end surfaces.

BRIEF DESCRIPTION OF THE DRAWINGS

A non-limiting embodiment of the present invention will be described by way of example with reference to the accompanying drawings, in which.

DETAILED DESCRIPTION OF THE INVENTION

Figure 1:
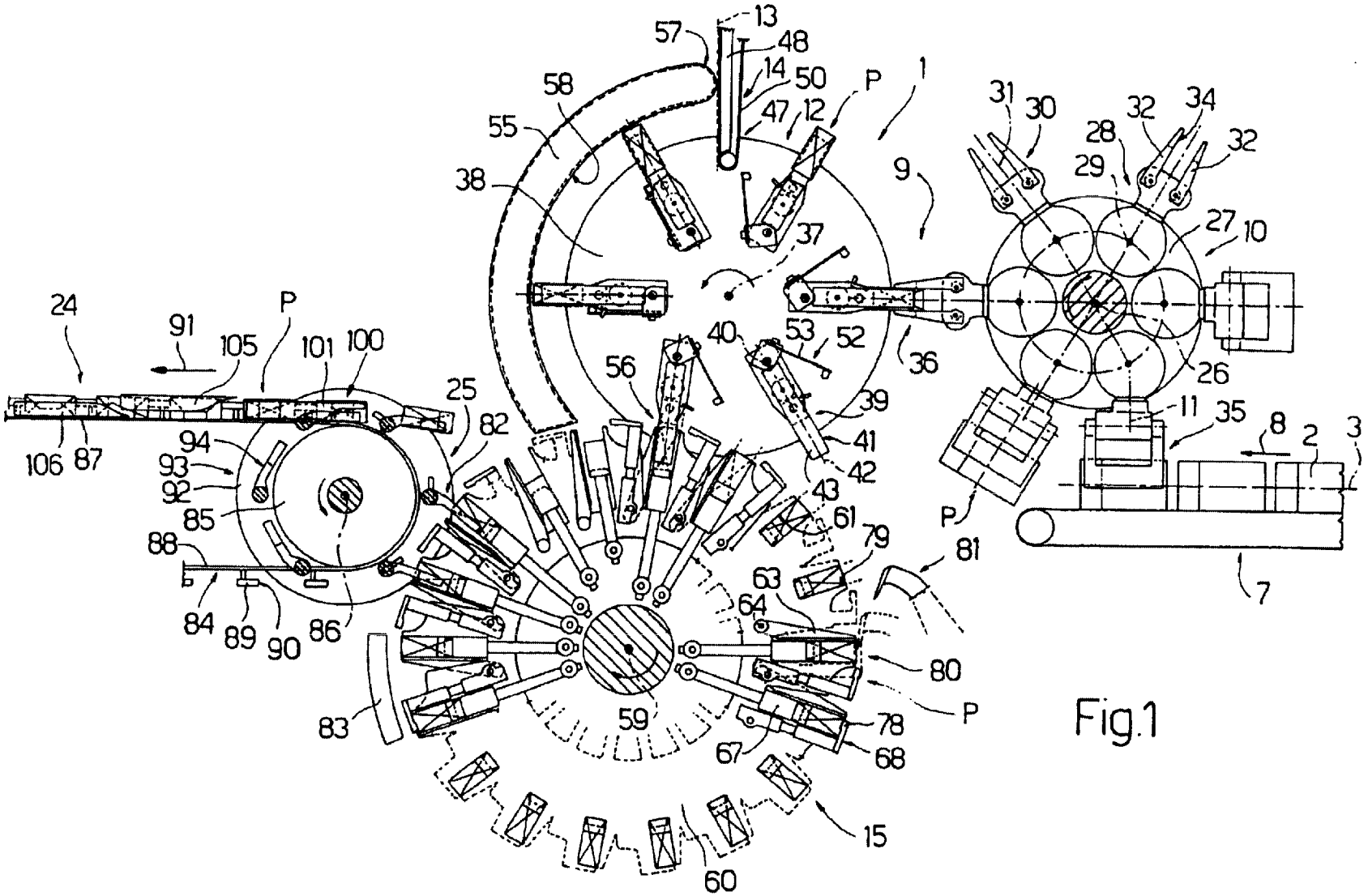
FIG. 1 shows a schematic side view, with parts removed for clarity, of a preferred embodiment of a machine implementing the method according to the present invention.
Figure 3:
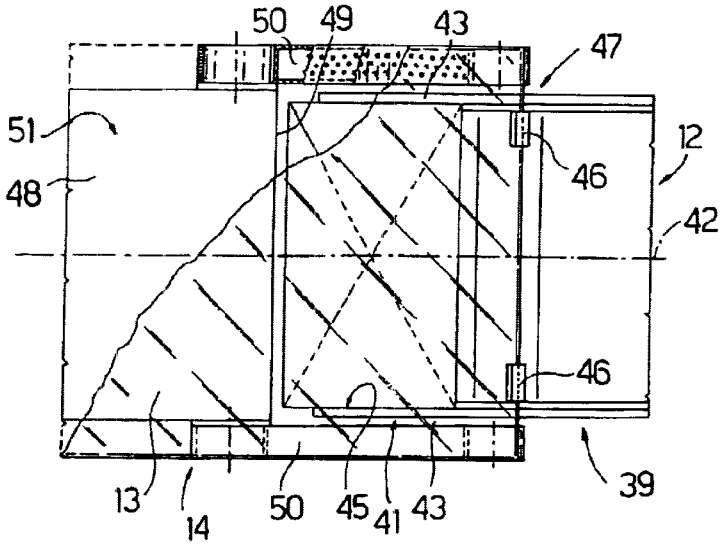
FIG. 3 shows a larger-scale front view of a second detail in FIG. 1.
Figure 11:
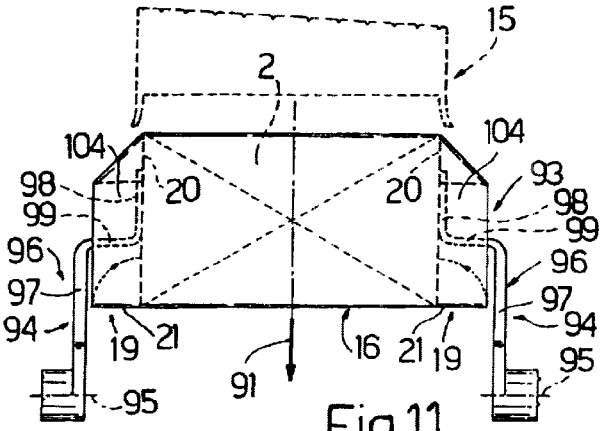
FIGS. 11 and 12 show larger-scale plan views of a detail in FIGS. 1 and 10.
Figure 2:
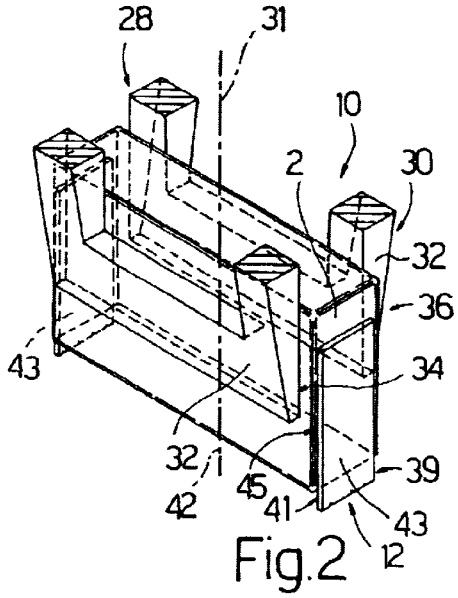
FIG. 2 shows a larger-scale, partial view in perspective of a first detail in FIG. 1.
Figure 12:
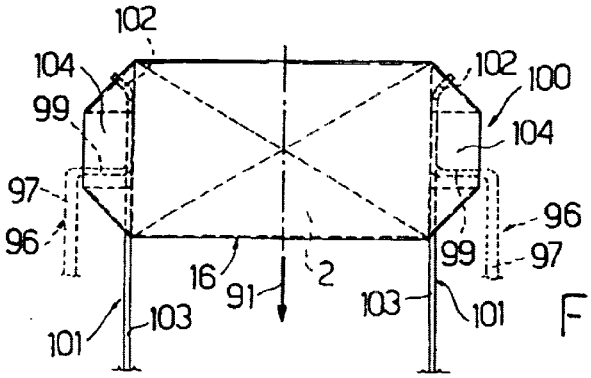
Figure 4A:
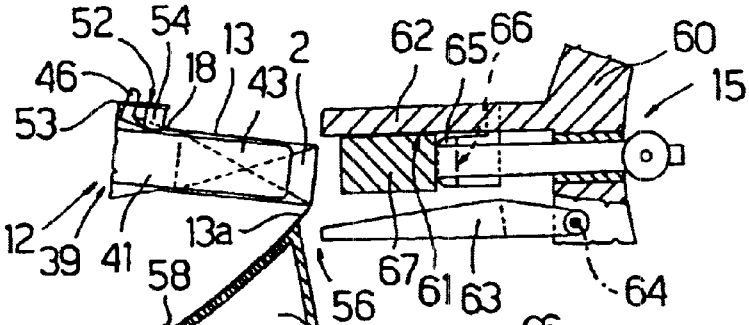
FIG. 4 shows a larger-scale, partial axial section of a third detail in FIG. 1 in a succession of operating steps.
Figure 4B:
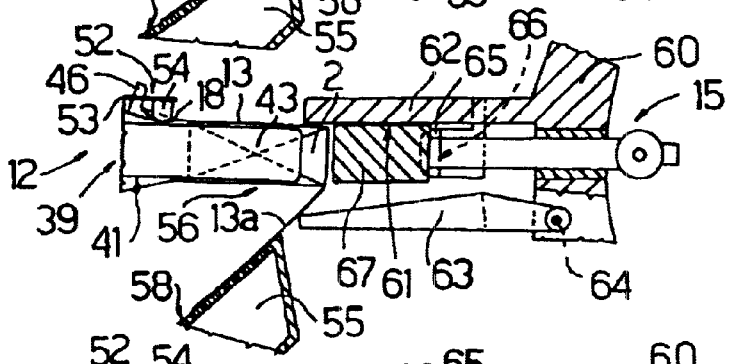
Figure 4C:
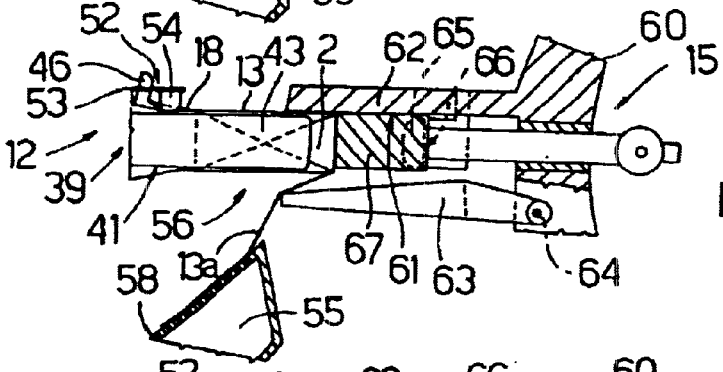
Figure 4D:
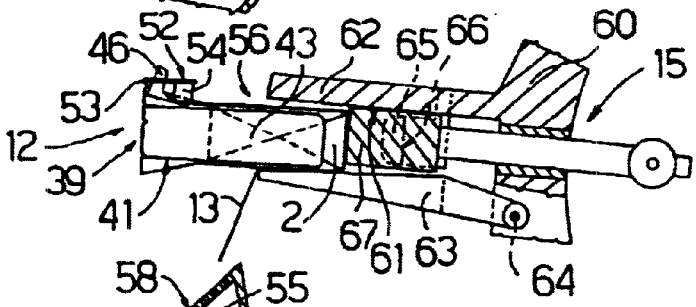
Figure 4E:
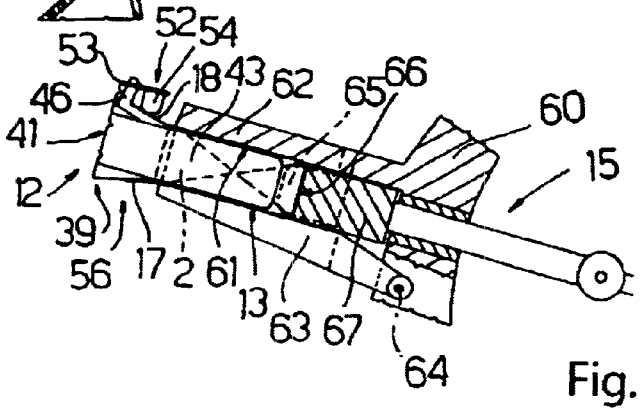
Figure 5A:
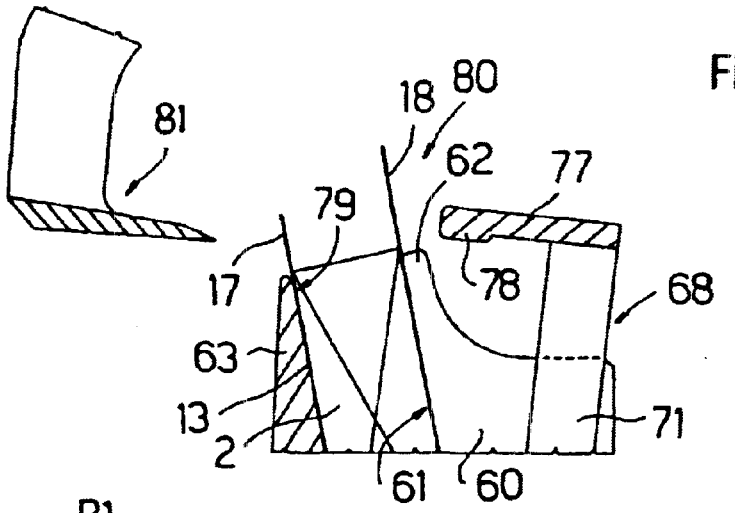
FIG. 5 shows a larger-scale, partial axial section of the FIG. 4 detail in a further succession of operating steps.
Figure 5B:
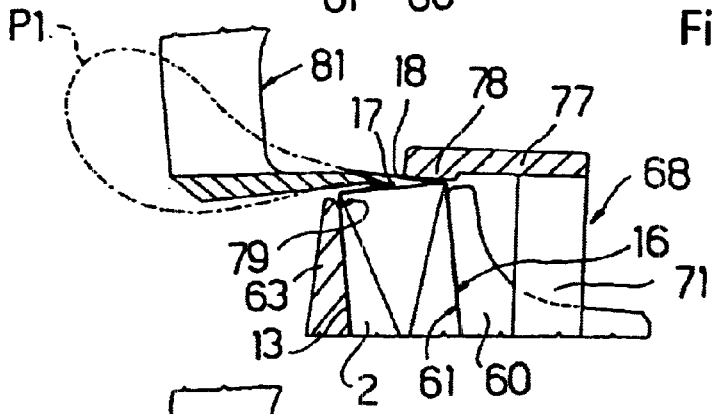
Figure 5C:
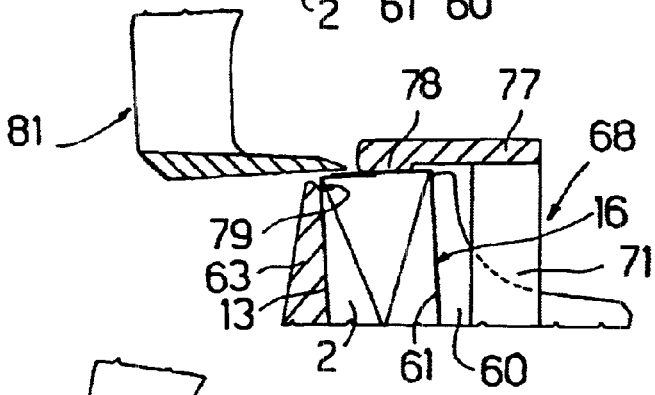
Figure 5D:
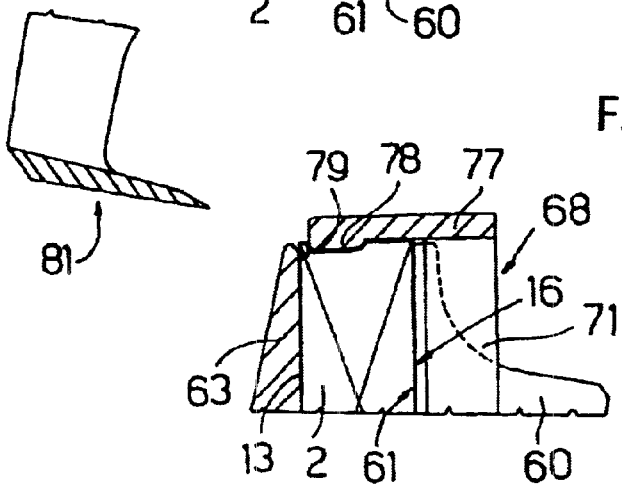
Figure 10:
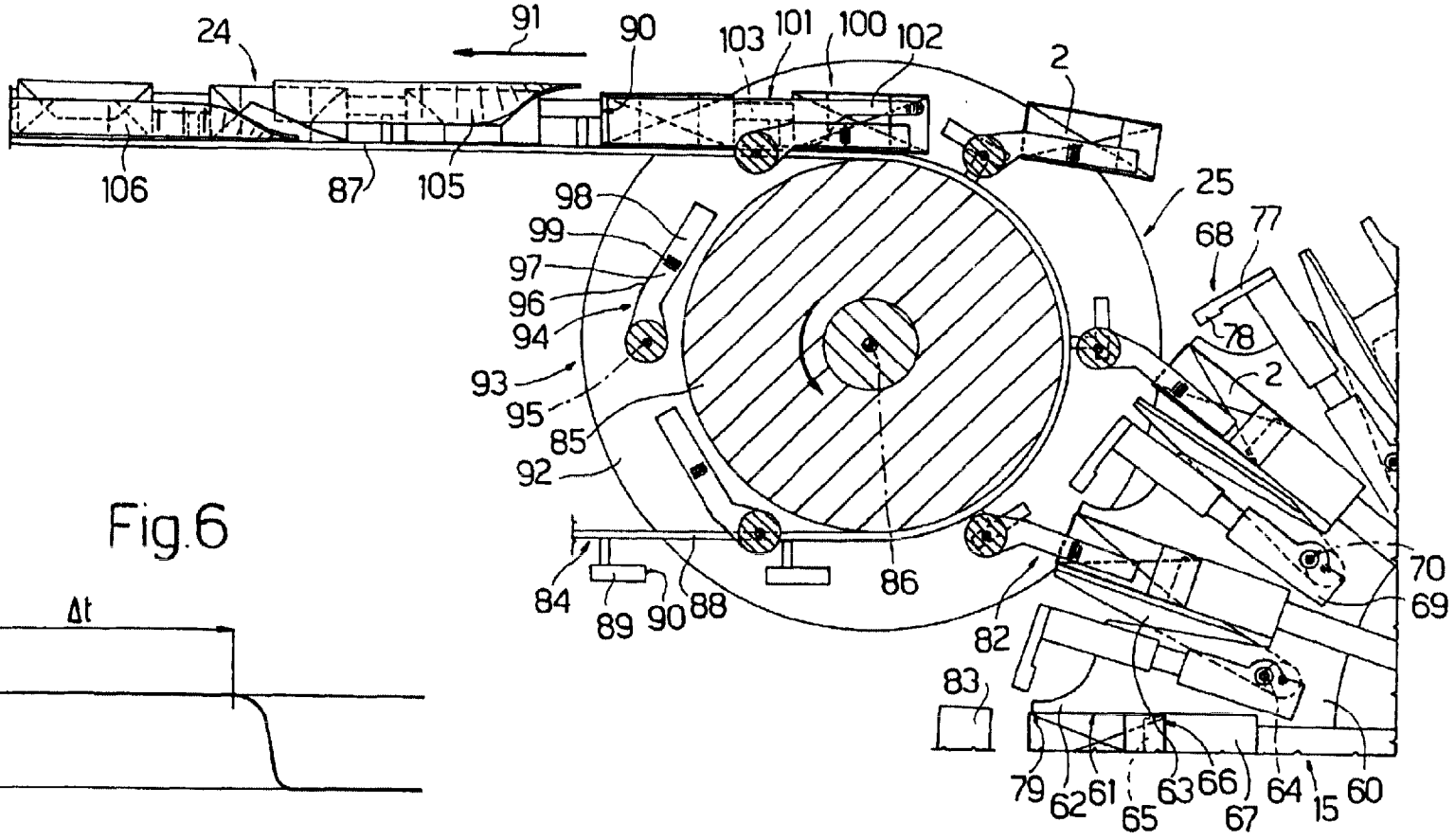
FIG. 10 shows a larger-scale view of a fourth detail in FIG. 1.
Figure 6:
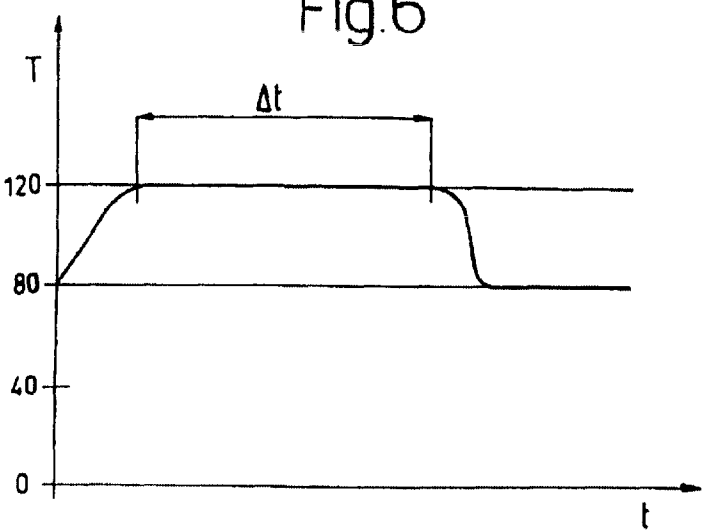
FIG. 6 shows a temperature-time operating graph of a detail in FIGS. 1 and 5.
Figure 9:
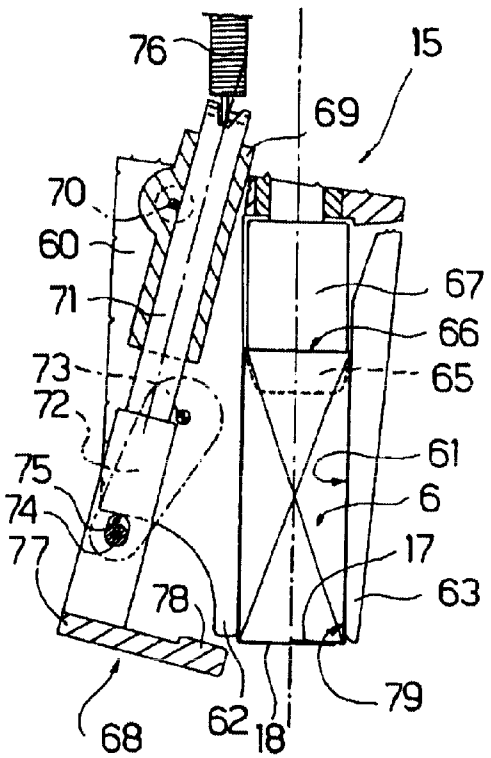
FIGS. 7, 8 and 9 show larger-scale, partial axial sections of the FIG. 4 detail in a further succession of operating steps.
Figure 8:
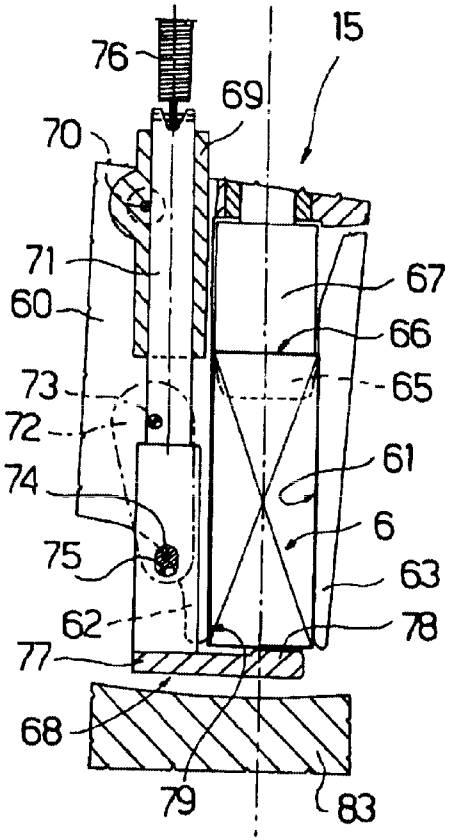
Figure 7:
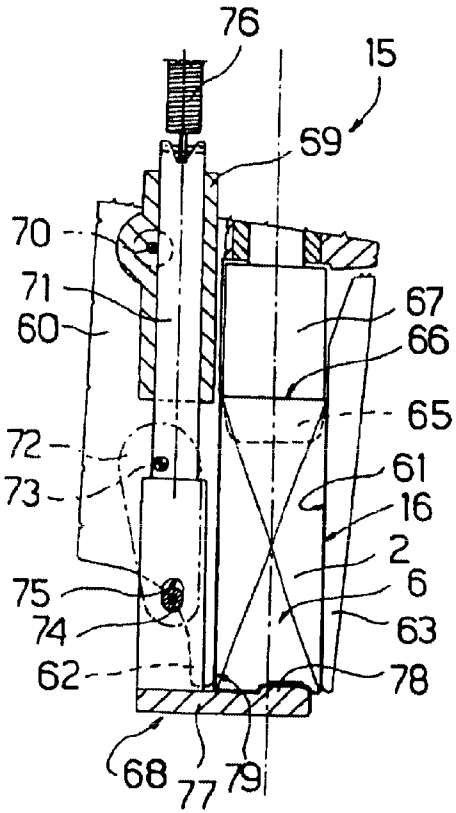
Figure 13A:
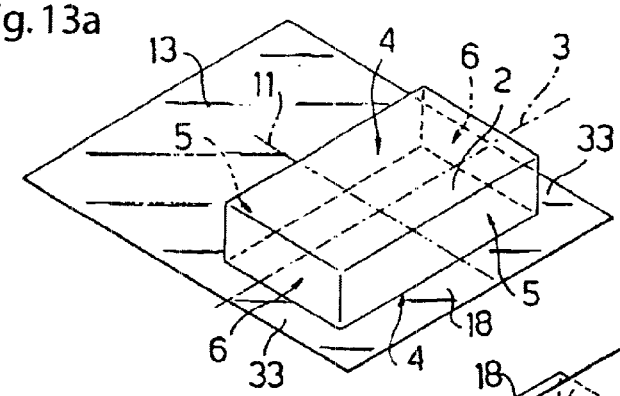
FIG. 13 shows, in perspective, a sequence for folding a sheet of wrapping material.
Figure 13B:
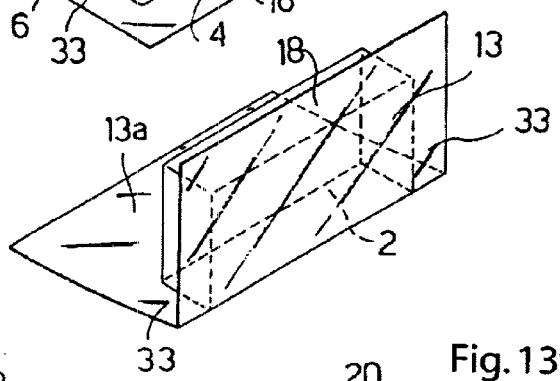
Figure 13C:
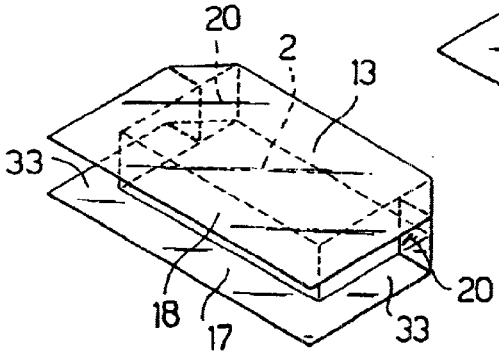
Figure 13F:
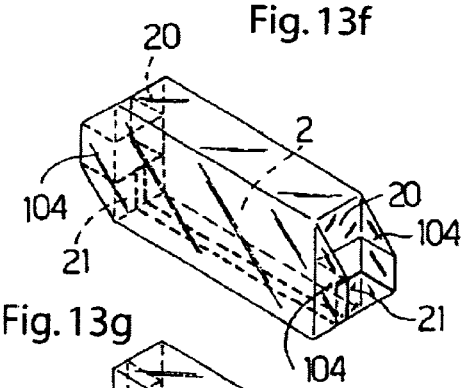
Figure 13D:
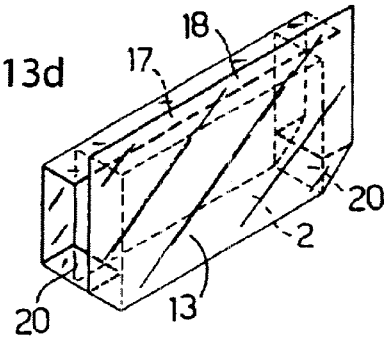
Figure 13G:
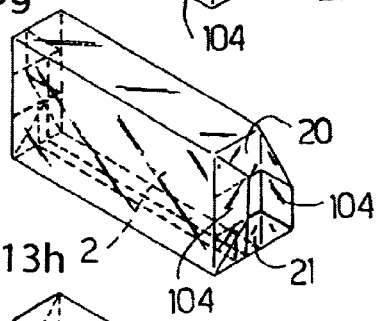
Figure 13E:
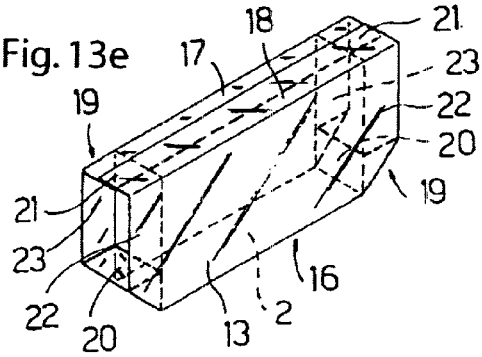
Figure 13H:
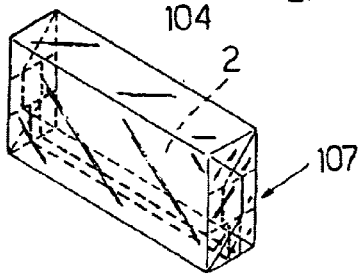

Number 1 in FIG. 1 indicates as a whole a machine for cellophaning packets 2 of cigarettes in the form of a substantially rectangular prism and comprising a longitudinal axis 3; two major lateral surfaces 4 parallel to each other and to longitudinal axis 3; two minor lateral surfaces 5 parallel to each other and to longitudinal axis 3, and perpendicular to major lateral surfaces 4; and two parallel end surfaces 6 perpendicular to longitudinal axis 3.

Machine 1 comprises a substantially horizontal input belt conveyor 7 for feeding an orderly succession of packets 2 on edge, i.e. with a minor lateral surface 5 resting on input conveyor 7, in an axial direction 8; and a centering unit 9 in turn comprising a turn-around wheel 10 substantially tangent to input conveyor 7 and for successively removing packets 2 off input conveyor 7 in direction 8 and turning each 90° about a turn-around axis 11 perpendicular to relative longitudinal axis 3 and to relative minor lateral surfaces 5, and a folding conveyor defined by a folding wheel 12 for successively receiving the turned-around on-edge packets 2 from turn-around wheel 10, and respective sheets 13 of wrapping material, normally polypropylene, from a feed unit 14, and for folding sheets 13 of wrapping material into an L about respective packets 2.

Machine 1 also comprises a further folding conveyor defined by a folding wheel 15 for receiving the on-edge packets 2 and respective L-folded sheets 13 of wrapping material, and for forming about each packet 2 a tubular wrapping 16 coaxial with longitudinal axis 3 of respective packet 2. Each tubular wrapping 16 comprises a minor lateral wall defined by two superimposed, sealed end portions 17 and 18 of respective sheet 13 of wrapping material; and two tubular axial appendixes 19, each of which is defined by a respective lateral portion 33 of respecttive sheet 13 of wrapping material projecting axially from relative end surface 6 of relative packet 2, and comprises two minor walls 20 and 21 substantially coplanar with relative minor lateral surfaces 5 of relative packet 2, and two major walls 22 and 23 substantially coplanar with relative major lateral surfaces 4 of relative packet 2.

Machine 1 also comprises an output conveyor 24 for feeding packets 2 successively to an output of machine 1 and for closing the ends of relative tubular wrappings 16; and a transfer unit 25 for feeding packets 2 and relative tubular wrappings 16 successively from folding wheel 15 to output conveyor 24.

Input conveyor 7, centering unit 9, folding wheel 15, transfer unit 25 and output conveyor 24 define, along machine 1, a substantially sinusoidal wrapping path P.

Turn-around wheel 10 is fitted to a frame (not shown) over the output end of input conveyor 7 to rotate continuously clockwise, in FIG. 1, about a respective axis 26 crosswise to feed direction 8. Turn-around wheel 10 comprises a powered disk 27 coaxial with and rotating about axis 26; and a number of gripping heads 28 equally spaced about axis 26 and fitted to disk 27 to oscillate, with respect to disk 27 and under the control of a known cam device (not shown), about respective axes 29 parallel to axis 26. Each gripping head 28 comprises a respective gripper 30, which extends along an axis 31 located radially with respect to relative axis 29, projects outwards of disk 27, and comprises two jaws 32 movable, with respect to each other in a direction crosswise to relative axis 31 and by virtue of a known cam actuating device (not shown), to and from a closed position in which the two jaws 32 define a relative seat 34 for a relative packet 2 positioned with a minor lateral surface 5 facing axis 26, and with major lateral surfaces 4 contacting jaws 32. Each gripper 30 is connected to the rest of relative gripping head 28 to rotate in 90° steps about relative axis 31 by virtue of a known cam actuating device (not shown).

In actual use, each gripper 30 approaches input conveyor 7 in a radial position with respect to axis 26 and with jaws 32 in an open position and parallel to feed direction 8. On nearing a transfer station 35 where packets 2 are transferred from input conveyor 7 to turn-around wheel 10, each gripper 30 is accelerated angularly with respect to disk 27 by rotating relative gripping head 28 about relative axis 29 in the same direction as disk 27; which rotation is inverted on gripper 30 reaching transfer station 35, so as to maintain gripper 30 substantially stationary with respect to relative packet 2 on input conveyor 7, and so enable packet 2 to penetrate transversely between jaws 32. At this point, gripper 30 is closed onto major lateral surfaces 4 of relative packet 2, and is reaccelerated to remove packet 2 off input conveyor 7 and feed it to a further transfer station 36 where packet 2 is transferred from turn-around wheel 10 to folding wheel 12.

As relative packet 2 is fed between transfer stations 35 and 36, each gripper 30 is turned 90° about relative axis 31 to turn relative packet 2 from an initial position in which packet 2 travels, as on input conveyor 7, with an end surface 6 forward, to a final transfer position in which relative packet 2 travels with a major lateral surface 4 forward.

Folding wheel 12 is fitted to a frame (not shown) in a position substantially tangent to turn-around wheel 10 so as to rotate continuously anticlockwise, in FIG. 1, about a respective axis 37 parallel to axis 26. Folding wheel 12 comprises a powered disk 38 coaxial with and rotating about axis 37; and a number of gripping heads 39 equally spaced about axis 37 and fitted to disk 38 to oscillate, with respect to disk 38 and under the control of a known cam device (not shown), about respective axes 40 parallel to axis 37. Each gripping head 39 comprises a respective gripper 41, which extends along an axis 42 located radially with respect to relative axis 40, projects outwards of disk 38, and comprises two jaws 43 movable, with respect to each other in a direction parallel to relative axis 40 and by virtue of a known cam actuating device (not shown), to and from a closed position in which the two jaws 43 define a relative seat 45 for a relative packet 2 positioned with a minor lateral surface 5—opposite the one formerly facing axis 26 of turn-around wheel 10—facing axis 37, and with end surfaces 6 contacting jaws 43.

From a lateral surface of each gripping head 39, located frontwards with reference to the rotation direction of folding wheel 12, a transverse plate 46, parallel to relative axis 40 and located between relative seat 45 and relative axis 40, projects frontwards and acts as a stop for a front edge of a relative sheet 13 of wrapping material fed by feed unit 14 to a supply station 47, downstream from transfer station 36, substantially synchronously with the passage of a gripping head 39 through supply station 47.

More specifically, feed unit 14, of known type, comprises a plate 48 parallel to and positioned radially with respect to axis 37, and which is substantially C-shaped with the concavity facing the periphery of folding wheel 12 to define a passage 49 for grippers 41 and relative packets 2; and two belts 50, which are permeable to air and provide for feeding sheets 13 of wrapping material along a surface 51 of plate 48, located frontwards in the traveling direction of gripping heads 39 and having suction holes for retaining sheets 13 of wrapping material in contact with belts 50 and in a position closing passage 49.

Each gripping head 39 comprises a further gripper 52 defined by a fixed jaw in turn defined by a body of gripping head 39, and by a movable jaw 53 which pivots about relative axis 40 to oscillate, with respect to the body of relative head 39, between an open position and a closed position in which an end pad 54 of jaw 53 is positioned radially outwards of relative plate 46 and contacting, at relative seat 45, the major lateral surface 4 of relative packet 2 located frontwards in the rotation direction of folding wheel 12.

Folding wheel 12 is also provided with a fixed folding and guide plate 55 extending, coaxially with axis 37, between supply station 47 and a transfer station 56 where packets 2 and relative sheets 13 of wrapping material are transferred to folding wheel 15. At the end facing supply station 47, plate 55 has a rounded edge 57 for folding each sheet 13 of wrapping material onto the outer minor lateral surface 5—opposite the one facing axis 37—of relative packet 2; and, on the side facing the periphery of folding wheel 12, plate 55 has a suction surface 58 for braking and smoothing sheets 13 of wrapping material onto said relative outer minor lateral surfaces 5.

In actual use, each gripping head 39 approaches transfer station 36 with grippers 41 and 52 in the open position to enable jaws 43 to receive a relative packet 2 fed to transfer station 36 by a corresponding gripper 30 on turn-around wheel 10; and, at transfer station 36, jaws 43 are moved into the closed position contacting respective end surfaces 6 of relative packet 2 to clamp packet 2 in an axial position in which the longitudinal axis 3 of packet 2 is parallel to axis 37, one of minor lateral surfaces 5 of packet 2 faces axis 37, and the two major lateral surfaces 4 of packet 2 are positioned substantially radially with respect to disk 38. Turn-around wheel 10 and folding wheel 12 are located such a distance apart that each jaw 43 in the closed position only cooperates with part of the length of relative end surface 6 of relative packet 2, and leaves exposed an outer portion of relative end surface 6 of a length, measured along axis 42, at least equal to the length of a tubular appendix 19.

In connection with the way in which each packet 2 is fed by input conveyor 7 to folding wheel 12 as described previously, it should be pointed out that, when a packet 2 is gripped by a relative gripper 30 on turn-around wheel 10, the position of the packet with respect to relative gripper 30 is undoubtedly correct in a radial direction with respect to disk 27, but may be slightly incorrect in a circumferential direction with respect to disk 27, so that, when packet 2 reaches transfer station 36, its position with respect to relative seat 45 is undoubtedly correct in a radial direction with respect to disk 38, but may be slightly off-center with respect to relative seat 45 in a direction parallel to axis 37. Any axial position error, however, is corrected upon relative gripper 30 opening and relative gripper 41 simultaneously closing, so that each packet 2, once transferred onto folding wheel 12, is perfectly centered radially, axially and circumferentially with respect to disk 38.

On receiving relative packet 2, each gripping head 39 moves towards supply station 47 supplying sheets 13, and gripper 41 engages passage 49 of plate 48. At the same time, a relative sheet 13 of wrapping material is supplied by feed unit 14 so that, as relative gripper 41 engages passage 49, the front edge of sheet 13 of wrapping material is arrested on plate 46 and remains in this position as sheet 13 contacts the front major lateral surface 4 of relative packet 2 and relative gripper 52 simultaneously closes to clamp sheet 13 onto front major lateral surface 4 of relative packet 2 and so enable relative gripping head 39 to detach sheet 13 from front suction surface 51 of plate 48 and insert it, together with relative packet 2, beneath plate 55.

As the part of sheet 13 projecting outwards of relative packet 2 contacts folding edge 57 of plate 55, sheet 13 is folded into an L about relative packet 2 so that a first portion projects inwards, with respect to front major lateral surface 4 of relative packet 2, to form relative end portion 18; a second portion centrally contacts front major lateral surface 4 of relative packet 2; a third portion centrally contacts the outer minor lateral surface 5 of relative packet 2; and a final portion, indicated 13*a*, projects rearwards with respect to outer minor lateral surface 5, is retained by suction on suction surface 58 of plate 55, and is therefore braked by plate 55 to smooth sheet 13 perfectly onto front major lateral surface 4 and outer minor lateral surface 5 of relative packet 2.

Each sheet 13 is maintained in this position until relative gripping head 39 reaches transfer station 56.

Folding wheel 15 is fitted to a fixed frame (not shown) in a position substantially tangent to folding wheel 12 to rotate continuously clockwise, in FIG. 1, about an axis 59 parallel to axis 37, and comprises a powered disk 60 coaxial with axis 59 and having a succession of radial pockets 61 open both-radially and axially outwards and each for receiving a relative packet 2 with relative sheet 13 of wrapping material.

Each pocket 61 is defined by a fixed wall 62 parallel to and positioned radially with respect to axis 59 and at the front in the rotation direction of folding wheel 15, and by a movable wall 63, which pivots on disk 60 to rotate, about a respecttive axis 64, to and from a closed position in which movable wall 63 is separated from relative fixed wall 62 by a distance approximately equal to but no less than the distance between major lateral surfaces 4 of packet 2. Two fixed folding devices 65 are provided across pocket 61, and are each defined by a plate between fixed wall 62 and movable wall 63, in a plane perpendicular to axis 59, and separated from the corresponding plate of the other fixed folding device 65 by a distance approximately equal to but no less than the distance between end surfaces 6 of packet 2. Each fixed folding device 65 is of a width, measured radially with respect to axis 59, smaller than the length of tubular appendixes 19, and is defined by a rounded outer edge, and by a flat inner edge, which, together with the flat inner edge of the other fixed folding device 65, defines a surface 66 parallel to axis 59, perpendicular to relative fixed wall 62, and defining an end surface of relative pocket 61.

A pusher 67 is mounted to slide along each pocket 61, and is movable radially along relative pocket 61 to and from a withdrawn position in which an end surface of pusher 67 is positioned facing outwards and coplanar with surface 66.

Each pocket 61 is provided with a fold-and-seal device 68 located on the fixed wall 62 side of relative seat 61, and which comprises a sleeve 69 hinged in a substantially radial position to disk 60 to oscillate about a respective fixed axis 70 parallel to axis 59, and a rod 71 mounted to slide along sleeve 69 and having a portion projecting outwards from sleeve 69. Rod 71 is controlled by a respective powered connecting rod 72, which is hinged to disk 60 to oscillate about an axis 73 parallel to axis 59, and is fitted on the free end with a pin 74 parallel to axis 59 and engaged in transversely sliding manner inside a slot 75 extending longitudinally along said projecting portion of rod 71. In normal working conditions, a spring 76, stretched between an inner end of rod 71 and a point on disk 60, maintains rod 71 in a normally withdrawn position with respect to sleeve 69 and with pin 74 resting transversely on the outer end of slot 75.

The portion of rod 71 projecting outwards from the outer end of relative sleeve 69 is fitted on the free end—located along the periphery of disk 60, at a distance from relative surface 66 substantially equal to the distance between minor lateral surfaces 5 of packet 2 when rod 71 is in the normal withdrawn position—with a crosspiece 77 facing relative pocket 61 and fitted, at the end of its surface facing axis 59, with a sealing bar 78 extending parallel to axis 59 along the whole of relative pocket 61, and substantially of the same length as tubular wrapping 16. Rod 71, together with relative sleeve 69, is oscillated by relative connecting rod 72 about axis 70 to slide crosspiece 77, along a peripheral surface of disk 60, between a position opening and a position substantially closing an inlet 79 of relative pocket 61, and in which sealing bar 78 is positioned as described below.

The oscillating movements of movable walls 63 and connecting rods 72, and the radial movements of pushers 67 are controlled by relative known cam actuating devices (not shown) fitted to disk 60.

In actual use, as an empty pocket 61 approaches transfer station 56 to receive a respecttive packet 2 from a respective gripping head 39 on folding wheel 12, relative crosspiece 77 is set to the position opening relative inlet 79, relative movable wall 63 is set to the open position, and relative pusher 67 is set to the withdrawn position with its outer end on a level with relative surface 66. As it is fed through transfer station 56, said packet 2, still retained by relative gripper 41, is eased inside pocket 61, together with relative sheet 13 of wrapping material, by oscillating relative gripping head 39 in known manner about relative axis 40. As packet 2 is inserted inside relative pocket 61, relative sheet 13 of wrapping material is folded into a U about packet 2 so as to contact the two major lateral surfaces 4 of packet 2 and the minor lateral surface 5 formerly facing plate 55 and now facing axis 59 of folding wheel 15.

At the same time, pusher 67 is moved outwards to contact and ease relative packet 2 down inside relative pocket 61. In this connection, it should be stressed that the main purpose of pusher 67 is to hold relative sheet 13 of wrapping material in place on relative packet 2 and prevent it from sliding out of position with respect to packet 2.

As packet 2 moves down inside relative pocket 61, the two minor lateral walls 20 of sheet 13 of wrapping material projecting from end surfaces 6 of packet 2 encounter relative fixed folding devices 65, by which they are folded onto and retained on respective end surfaces 6.

Once packet 2 is-inserted completely inside relative pocket 61, with inner minor lateral surface 5 coplanar with surface 66, and with outer minor lateral surface 5 tangent to a peripheral surface of disk 60, grippers 41 and 52 are opened to release packet 2 onto folding wheel 15, and relative movable wall 63 is moved into the closed position to secure packet 2 and relative sheet 13 of wrapping material inside relative pocket 61, with sheet 13 of wrapping material folded into a U about packet 2 so that relative end portions 17 and 18 project radially outwards of inlet 79 of relative pocket 61.

Packet 2 is then fed by folding wheel 15 to a folding station 80, where an outer folding device 81, guided cyclically in known manner by a known actuating device (not shown) along an endless path P1 having a branch tangent to the outer periphery of disk 60, folds end portion 17—located behind relative end portion 18 in the traveling direction of relative packet 2—forward onto outer minor lateral surface 5 of relative packet 2. At the same time, before folding device 81 moves back after releasing the folded end portion 17, fold-and-seal device 68 is moved into the closed position to fold relative end portion 18 onto outer minor lateral surface 5 of relative packet 2, with an end portion of end portion 18 overlapping relative end portion 17 and directly beneath sealing bar 78, which seals end portions 17 and 18 to form relative tubular wrapping 16 before packet 2 reaches a transfer station 82 where packet 2, together with relative tubular wrapping 16, is extracted from relative pocket 61 by transfer unit 25 and transferred to output conveyor 24.

It should be pointed out that sealing bar 78 is designed for minimum thermal inertia, is maintained, for most of the time taken to make a complete turn about axis 59, at a relatively low working temperature, preferably about 80° C., and, as soon as relative fold-and-seal device 68 moves into the closed position, is brought to a higher sealing temperature, preferably about 120° C., for a constant time period T independent of the rotation speed of folding wheel 15, so as to prevent any variation in the rotation speed of folding wheel 15 from resulting in nonsealing of tubular wrappings 16 or in singeing of sheets 13 of wrapping material.

Just before reaching transfer station 82, fold-and-seal device 68 is moved into the open position to permit withdrawal of relative packet 2 and relative tubular wrapping 16 from relative pocket 61. To prevent relative crosspiece 77, as it moves into the open position, from detaching relative end portion 18 just folded and sealed onto relative end portion 17, crosspiece 77, before moving into the open position, is attracted outwards, in opposition to relative spring 76 and so that relative pin 74 cooperates transversely with the inner end of relative slot 75, by a permanent magnet 83 located outwards of the outer periphery of disk 60, immediately upstream from transfer station 82, so that crosspiece 77 is detached from relative tubular wrapping 16 before moving into the open position, and is kept detached throughout the opening movement.

Output conveyor 24 comprises an endless belt 84 extending about a pulley 85, which is substantially tangent to disk 60 of folding wheel 15, is fitted to a frame (not shown) to rotate continuously anticlockwise, in FIG. 1, about an axis 86 parallel to axis 59, and defines, on belt 84, a substantially horizontal conveying branch 87 and a substantially horizontal return branch 88. Teeth 89 project outwards from belt 84 to define a succession of conveying pockets 90, each for receiving, on conveying branch 87, a packet 2 complete with relative tubular wrapping 16 and positioned with a major lateral surface 4 facing conveying branch 87, and with longitudinal axis 3 crosswise to the traveling direction 91 of conveying branch 87.

At one axial end, pulley 85 has an annular flange 92 forming part of a transfer wheel 93, which, together with pulley 85, defines transfer unit 25. In addition to flange 92, transfer wheel 93 also comprises a number of grippers 94 equally spaced about axis 86 and which oscillate on flange 92 about respective hinge axes 95 parallel to axis 86.

Each gripper 94 comprises two jaws 96, each of which is defined by a relative metal strip bent substantially into an S and preferably narrower than half the distance between the two major lateral surfaces 4 of a packet 2. Each jaw 96 comprises an inner portion 97 pivoting on flange 92; and an outer portion 98 of a length substantially equal to the distance between the minor lateral surfaces 5 of a packet 2 minus twice the length of one of the two tubular appendixes 19 of tubular wrappings 16. Inner and outer portions 97 and 98 of each jaw 96 are substantially parallel to each other, are crosswise to relative axis 95, and are connected to each other by an intermediate portion 99 substantially parallel to relative axis 95, extending from an outer end of relative inner portion 97 towards the other jaw 96, and longer than one of tubular appendixes 19 of tubular wrappings 16. The two jaws 96 of each gripper 94 are movable, along relative axis 95, between a closed position in which relative outer portions 98 are separated by a distance substantially equal to the distance between end surfaces 6 of a packet 2, and an open position in which relative outer portions 98 are separated by a distance greater than the length of a tubular wrapping 16.

In actual use, as soon as relative crosspiece 77 moves into the open position opening relative inlet 79, each pocket 61 inserts relative packet 2 and relative tubular wrapping 16 between the outer portions 98 of open jaws 96 of a relative gripper 94 fed by transfer wheel 93 to transfer station 82 in time with said pocket 61. Jaws 96 of gripper 94 being open, the whole of tubular wrapping 16 of relative packet 2 can be inserted between jaws 96 without tubular appendixes 19 engaging relative outer portions 98. At this point, packet 2 and relative gripper 94 are fed together to transfer station 82, while gripper 94, oscillating in known manner about respective axis 95 by means of a known cam device (not shown), is kept aligned with relative pocket 61, with the outer portion 98 of each jaw 96 facing a respective end surface 6 of relative packet 2 adjacent to the major lateral wall 23 of relative tubular appendix 19. At transfer station 82, pusher 67 begins moving outwards to insert relative packet 2 completely inside relative pocket 90. When packet 2 is inserted fully inside relative pocket 90, outer portion 98 of each jaw 96 is positioned with an outer end portion facing the portion of minor lateral wall 20 of relative tubular appendix 19 projecting from relative fixed folding device 65, and with its inner end separated from the minor lateral wall 21 of relative tubular appendix 19 by a distance greater than the length of relative minor lateral wall 21.

At this point, gripper 94 is closed to secure relative packet 2 to transfer wheel 93, and to keep the minor lateral walls 20 of tubular appendixes 19 of packet 2 in the folded position. At the same time, movable wall 63 of relative pocket 61 is moved into the open position to release and enable removal of relative packet 2 by relative gripper 94.

On gripping relative packet 2, gripper 94 continues oscillating about relative axis 95 and rotating about axis 86 to feed relative packet 2, complete with relative tubular wrapping 16, to the input of conveying branch 87 in such a position that a major lateral surface 4 is substantially coplanar with conveying branch 87, and to insert packet 2 inside a relative pocket 90 at a release station 100 where gripper 94 is opened to release the packet onto output conveyor 24.

In the course of the above operation, and before relative packet 2 is inserted fully inside relative pocket 90, gripper 94 inserts packet 2 between two folding rods 101 extending along opposite sides of conveying branch 87, parallel to traveling direction 91, and separated by a distance approximately equal to but no less than the distance between end surfaces 6 of packet 2. More specifically, each folding rod 101 comprises a relatively narrow initial portion 102 located entirely upstream from release station 100 and for interfering with a portion of relative end surface 6 left exposed by outer portion 98 of relative jaw 96; and a following wider portion 103, which commences immediately upstream from release station 100 and is wide enough to interfere with the whole of relative end surface 6.

In actual use, each initial portion 102 of each folding rod 101 interferes with part of minor lateral wall 21 of relative tubular appendix 19 to fold minor lateral wall 21 at least partly onto relative end surface 6 of relative packet 2 and subsequently secure in position the relative minor lateral wall 20 already folded by fixed folding devices 65. Just before reaching release station 100, portion 103 intervenes to fold relative minor lateral wall 21 completely and perfectly, and the gripper 94 is opened just before the inner end of outer portion 98 of relative jaws 96 reach a sloping input edge of portion 103.

At this point, each tubular appendix 19 has been reduced to two straightforward wings 104 defined by part of respective major lateral walls 22 and 23, and which are folded one on top of the other in known manner by respective cylindrical spiral folding devices 104 and 105, and sealed to each other by a respective known sealing device (not shown) to form a closed overwrapping 107.

What is claimed is:

1. A method of overwrapping packets substantially in the form of a rectangular prism defined axially by two opposite end surfaces (6), and laterally by two major lateral surfaces (4) and two minor lateral surfaces (5) parallel to a longitudinal axis (3) of the rectangular prism; the packets (2) being overwrapped as they are fed, in a given feed direction, along a given wrapping path (P); the method comprising, for each packet (2), a pairing step to pair the packet (2) with a relative sheet (13) of wrapping material;

a first folding step to fold the sheet (13) of wrapping material into a U about the packet (2) so that the sheet (13) of wrapping material has two projecting lateral portions (33), each projecting from a respective said end surface (6);

a second folding step to further fold the sheet (13) of wrapping material about the packet (2) and form, about the packet (2), a tubular wrapping (16) comprising two tubular appendixes (19) projecting from respective said end surfaces (6) of the packet (2) and defined by said two projecting lateral portions (33); a sealing step to stabilize said tubular wrapping (16);

and a third folding step to fold each said tubular appendix (19) onto the respective end surface (6) of the packet (2) to obtain a closed overwrapping (107);

said packet (2) being fed continuously along said wrapping path (P); and each said projecting lateral portion (33) of the sheet (13) of wrapping material being folded at least partly onto the relative said end surface (6) prior to said second folding step;

the method being characterized by comprising, prior to said pairing step, a centering step to center the packet (2) with respect to said wrapping path (P); the centering step being performed by gripping said packet (2), by means of a first gripper (30), by two (4) of said lateral surfaces (4, 5); feeding the packet (2) axially along a respective portion of said wrapping path (P) by means of said first gripper (30); rotating said first gripper (30) about a turn-around axis (11) crosswise to said wrapping path (P) and to said longitudinal axis (3) so as to position the packet with a first of said two lateral surfaces (4) forward; and transferring said packet (2) to a second gripper (41), which grips the packet (2) by said two end surfaces (6).

2. A method as claimed in claim 1, wherein said packet (2) is rotated around about said turn-around axis (11), as the packet (2) is fed along the wrapping path (P).

3. A method as claimed in claim 2, wherein said two lateral surfaces (4) are said major lateral surfaces (4).

4. A method as claimed in claim 3, wherein said first folding step comprises a first substep in which said sheet (13) of wrapping material is folded into an L; and a second substep in which the L-folded said sheet (13) of wrapping material is further folded into a U.

5. A method as claimed in claim 4, wherein said first substep is performed by securing said sheet (13) of wrapping material with respect to said packet (2) so that a central portion of an intermediate portion of the sheet (13) of wrapping material is positioned contacting a first said lateral surface (4) facing forward in said feed direction, a first end portion of the sheet (13) of wrapping material projects from said first lateral surface (4), and a remaining portion **(13*a*) of the sheet (13) of wrapping material projects from said first lateral surface (4), on the opposite side to said first end portion (18); and by folding said remaining portion (13*a*) of the sheet (13)** of wrapping material squarely and rearwards with respect to said feed direction.

6. A method as claimed in claim 5, wherein, once folded squarely, said remaining portion **(13*a*) is braked to smooth said sheet (13) of wrapping material onto said packet (2)**.

7. A method as claimed in claim 6, wherein said remaining portion (13*a*) is braked by suction.

8. A method as claimed in claim 7, wherein said remaining portion (13*a*) is folded squarely and rearwards by feeding the packet (2) along said wrapping path (P) and by interference with a fixed folding member (55) comprising a folding edge (57) for folding said remaining portion (13*a*) rearwards, and a following suction surface (58) extending along said wrapping path (P) and cooperating with the folded said remaining portion (13*a*) to smooth said sheet (13) of wrapping material onto the packet (2).

9. A method as claimed in claim 8, wherein said second substep is performed by transferring the packet (2) and the L-folded said sheet (13) of wrapping material from a first (45) to a second (61) seat, which move along respective portions of said wrapping path (P) and are positioned facing each other during transfer; the U-folded said sheet (13) of wrapping material being arranged inside said second seat (61) so that a first (18) and a second (17) end portion of the sheet (13) of wrapping material project from an inlet (79) of said second seat (61) and towards said first seat (45), and each said projecting lateral portion (33) of the sheet (13) of wrapping material projects from said second seat (61) crosswise to said first and said second end portion (18, 17).

10. A method as claimed in claim 9, wherein said projecting lateral portion (33) of the sheet of wrapping material is folded at least partly onto the relative said end surface (6) in the course of said second substep.

11. A method as claimed in claim 10, wherein the U-folded said sheet (13) of wrapping material is arranged contacting a first and a second said lateral surface (4, 4) and a third said lateral surface (5) between the first and second said lateral surface (4, 4); a portion of each said projecting lateral portion (33), coplanar with said third lateral surface (5), being folded onto the relative said end surface (6) in the course of said second substep.

12. A method as claimed in claim 11, wherein each said projecting lateral portion (33) of the sheet of wrapping material is folded at least partly onto the relative said end surface (6) by interference with a respective folding device (65) fixed to said second seat (61).

13. A method as claimed in claim 12, wherein, in the course of said second substep, a portion of said sheet (13) of wrapping material is secured to said packet (2).

14. A method as claimed in claim 13, wherein each said projecting lateral portion (33) of the sheet of wrapping material is folded partly onto the relative said end surface (6) by transferring the packet (2) and said sheet (13) of wrapping material from a first (45) to a second (61) seat, which move along respective portions of said wrapping path (P) and are positioned facing each other during transfer; said first seat (45) cooperating with said packet (2) at said end surfaces (6) and so that each said end surface (6) has a projecting portion projecting outwards of said first seat (45) by a length at least equal to a width of the relative said projecting lateral portion (33); a portion (20) of each said projecting lateral portion (33), located at a respective said projecting portion of the relative end surface (6), being folded onto the relative end surface (6) as the packet (2) and the relative sheet (13) of wrapping material are transferred from said first (45) to said second (61) seat.

15. A method as claimed in claim 14, wherein said portion (20) of each projecting lateral portion (33) is folded onto the relative projecting portion of the relative end surface (6) by interference with a respective folding device (65) fixed to said second seat (61).

16. A method as claimed in claim 15, wherein said packet (2) and the sheet (13) of wrapping material are inserted inside said second seat (61) while maintaining a portion of said sheet (13) of wrapping material secured in place on said packet (2).

17. A method as claimed in claim 16, wherein said portion of the sheet (13) of wrapping material is secured in place on the packet (2) by means of a pusher (67) movable along said second seat (61) to and from said first seat (45).

18. A method as claimed in claim 17, herein said second folding step is performed by inserting the packet (2) and the U-folded said sheet (13) of wrapping material inside a conveying pocket (61), so that a first (18) and a second (17) end portion of the sheet (13) of wrapping material project from an inlet (79) of said conveying pocket (61) and crosswise to said wrapping path (P), with said first end portion (18) in front of said second end portion (17) in said feed direction; feeding said conveying pocket (61) through a folding station (80), located along said wrapping path (P), to fold said second end portion (17) squarely in said feed direction; and moving a folding member (68), movable with said conveying pocket (61) along said wrapping path (P), across said inlet (79) in the opposite direction to said feed direction and from an open position opening to a closed position closing said inlet (79) to fold said first end portion (18) squarely onto said first end portion (17) so that said first and said second end portion (18, 17) have an overlapping portion.

19. A method as claimed in claim 18, wherein said folding member (68) is a fold-and-seal device comprising a sealing element (78) which, when the folding member (68) is in said closed position, is located at said overlapping portion; said folding member (68) being maintained in said closed position along a given portion of said wrapping path (P); and said sealing step being performed as said folding member (68) is fed along said given portion of the wrapping path (P).

20. A method as claimed in claim 19, wherein said sealing element (78) is temperature-controlled to normally remain at a relatively low, substantially constant temperature, and to assume a relatively high sealing temperature for a constant time interval as it is fed along said given portion of the wrapping path (P).

21. A method as claimed in claim 20, wherein said sealing step is performed by means of a sealing element (78) movable with said packet (2) and said tubular wrapping (16) along a portion of said wrapping path (P); said sealing element (78) being temperature-controlled to normally remain at a relatively low, substantially constant temperature, and to assume a relatively high sealing temperature for a constant time interval as it is fed along said given portion of the wrapping path (P).

22. A method as claimed in claim 21, wherein said relatively low temperature is about 80° C.

23. A method as claimed in claim 22, wherein said sealing temperature is about 120° C.

24. A method as claimed in claim 23, wherein, at least in the course of said folding steps, said packet (2) is fed along said wrapping path (P) with one (4) of said lateral surfaces (4, 5) forward in said feed direction.

25. A method as claimed in claim 24, wherein, at least in the course of said pairing step and said first and second folding step, said packet (2) is fed along said wrapping path (P) with one of said major lateral surfaces (4) forward in said feed direction.

26. A method as claimed in claim 25, wherein, at least in the course of said third folding step, said packet (2) is fed along said wrapping path (P) with one of said minor lateral surfaces (5) forward in said feed direction.

27. A method as claimed in claim 26, wherein, in the course of said pairing and folding steps, said packet (2) is fed along said wrapping path (P) with one of said lateral surfaces (4, 5) forward in said feed direction; said pairing step being performed at a pairing station (47) located at a given point along said wrapping path (P); and, at least along a portion of said wrapping path (P) upstream from said pairing station (47), the packet (2) being fed with a said end surface (6) forward in said feed direction.

28. A method as claimed in claim 27, wherein said packet (2) is fed along at least part of said wrapping path (P) by means of a succession of wheels (10, 12, 15, 93) which transfer the packet (2) at a succession of transfer stations (36, 56, 82); each wheel (10, 12, 15, 93) having at least one respective gripping member (30, 41, 61, 94) for said packet (2), and being located adjacent to at least one other said wheel (10, 12, 15, 93); and, at each pair of adjacent said wheels (10, 12; 12, 15; 15, 93), the gripping member of one of the two adjacent wheels (10, 12; 12, 15; 15, 93) cooperating with two parallel, opposite said lateral surfaces (4, 5) of said packet (2), and the gripping member of the other wheel cooperating with said end surfaces (6) of said packet (2).

* * * * *

UNITED STATES PATENT AND TRADEMARK OFFICE

CERTIFICATE OF CORRECTION

PATENT NO. : 6,643,996 B2
DATED : November 11, 2003
INVENTOR(S) : Mario Spatafora et al.

It is certified that error appears in the above-identified patent and that said Letters Patent is hereby corrected as shown below:

Title page,
Item [73], Assignee, "G. D. Societa' per Azioni" should be -- G.D Societa' per Azioni --

Signed and Sealed this

Twentieth Day of January, 2004

JON W. DUDAS
*Acting Director of the United States Patent and Trademark Office*